US006957949B2

(12) United States Patent
Hyde et al.

(10) Patent No.: US 6,957,949 B2
(45) Date of Patent: Oct. 25, 2005

(54) INTERNAL COOLING CIRCUIT FOR GAS TURBINE BUCKET

(75) Inventors: Susan Marie Hyde, Schenectady, NY (US); Richard Mallory Davis, Scotia, NY (US)

(73) Assignee: General Electric Company, Schenectady, NY (US)

( * ) Notice: Subject to any disclaimer, the term of this patent is extended or adjusted under 35 U.S.C. 154(b) by 434 days.

(21) Appl. No.: 09/777,998

(22) Filed: Feb. 7, 2001

(65) Prior Publication Data

US 2001/0018024 A1 Aug. 30, 2001

Related U.S. Application Data

(63) Continuation of application No. 09/236,714, filed on Jan. 25, 1999, now abandoned.

(51) Int. Cl.[7] ..... B63H 1/14
(52) U.S. Cl. ..... 416/97 R; 416/96 R
(58) Field of Search ..... 416/97 R, 96 R

(56) References Cited

U.S. PATENT DOCUMENTS 4,604,031 A * 8/1986 Moss et al. ..... 416/97 R
5,472,316 A * 12/1995 Taslim et al. ..... 416/96 R
5,536,143 A * 7/1996 Jacala et al. ..... 416/96 R
6,019,579 A * 2/2000 Fukuno et al. ..... 416/96 R

OTHER PUBLICATIONS

"39th GE Turbine State–of–the–Art Technology Seminar", Tab 1,""F" Technology—the First Half–Million Operating Hours", H.E. Miller.

"39th GE Turbine State–of–the–Art Technology Seminar", Tab 2, "GE Heavy–Duty Gas Turbine Performance Characteristics", F. J. Brooks.

"39th GE Turbine State–of–the–Art Technology Seminar", Tab 3, "9EC 50Hz 170–MW Class Gas Turbine", A. S. Arrao.

"39th GE Turbine State–of–the–Art Technology Seminar", Tab 4, "MWS6001FA—An Advanced–Technology 70–MW Class 50/60 Hz Gas Turbine", Ramachandran et al.

"39th GE Turbine State–of–the–Art Technology Seminar", Tab 5, "Turbomachinery Technology Advances at Nuovo Pignone", Benvenuti et al.

"39th GE Turbine State–of–the–Art Technology Seminar", Tab 6, "GE Aeroderivative Gas Turbines—Design and Operating Features", M.W. Homer.

"39th GE Turbine State–of–the–Art Technology Seminar", Tab 7, "Advance Gas Turbine Materials and Coatings", P.W. Schilke.

"39th GE Turbine State–of–the–Art Technology Seminar", Tab 8, "Dry Low $NO_x$ Combustion Systems for GE Heavy–Duty Turbines", L. B. Davis.

"39th GE Turbine State–of–the–Art Technology Seminar", Tab 9, "GE Gas Turbine Combustion Flexibility", M. A. Davi.

(Continued)

*Primary Examiner*—Edward K. Look
*Assistant Examiner*—Richard Woo
(74) *Attorney, Agent, or Firm*—Nixon & Vanderhye P.C.

(57) ABSTRACT

In a gas turbine bucket having a shank portion and an airfoil portion having leading and trailing edges and pressure and suction sides, an internal cooling circuit, the internal cooling circuit having a serpentine configuration including plural radial outflow passages and plural radial inflow passages, and wherein a coolant inlet passage communicates with a first of the radial outflow passages along the trailing edge, the first radial outflow passage having a plurality of radially extending and radially spaced elongated rib segments extending between and connecting the pressure and suction sides in a middle region of the first passage to prevent ballooning of the pressure and suction sides at the first radial outflow passage.

15 Claims, 3 Drawing Sheets

OTHER PUBLICATIONS

"39th GE Turbine State–of–the–Art Technology Seminar", Tab 10, "Gas Fuel Clean–Up System Design Considerations for GE Heavy–Duty Gas Turbines", C. Wilkes.
"39th GE Turbine State–of–the–Art Technology Seminar", Tab 11, "Integrated Control Systems for Advanced Combined Cycles", Chu et al.
"39th GE Turbine State–of–the–Art Technology Seminar", Tab 12, "Power Systems for the 21st Century "H" Gas Turbine Combined Cycles", Paul et al.
"39th GE Turbine State–of–the–Art Technology Seminar", Tab 13, "Clean Coal and Heavy Oil Technologies for Gas Turbines", D. M. Todd.
"39th GE Turbine State–of–the–Art Technology Seminar", Tab 14, "Gas Turbine Conversions, Modifications and Uprates Technology", Stuck et al.
"39th GE Turbine State–of–the–Art Technology Seminar", Tab 15, "Performance and Reliability Improvements for Heavy–Duty Gas Turbines, "J.R. Johnston.
"39th GE Turbine State–of–the–Art Technology Seminar", Tab 16, "Gas Turbine Repair Technology", Crimi et al.
"39th GE Turbine State–of–the–Art Technology Seminar", Tab 17, "Heavy Duty Turbine Operating & Maintenance Considerations", R. F. Hoeft.
"39th GE Turbine State–of–the–Art Technology Seminar", Tab 18, "Gas Turbine Performance Monitoring and Testing", Schmitt et al.
"39th GE Turbine State–of–the–Art Technology Seminar", Tab 19, "Monitoring Service Delivery System and Diagnostics", Madej et al.
"39th GE Turbine State–of–the–Art Technology Seminar", Tab 20, "Steam Turbines for Large Power Applications", Reinker et al.
"39th GE Turbine State–of–the–Art Technology Seminar", Tab 21, "Steam Turbines for Ultrasupercritical Power Plants", Retzlaff et al.
"39th GE Turbine State–of–the–Art Technology Seminar", Tab 22, "Steam Turbine Sustained Efficiency", P. Schofield.
"39th GE Turbine State–of–the–Art Technology Seminar", Tab 23, "Recent Advances in Steam Turbines for Industrial and Cogeneration Applications", Leger et al.
"39th GE Turbine State–of–the–Art Technology Seminar", Tab 24, "Mechanical Drive Steam Turbines", D. Leger.
"39th GE Turbine State–of–the–Art Technology Seminar", Tab 25, "Steam Turbines for STAG™ Combined–Cycle Power Systems", M. Boss.
"39th GE Turbine State–of–the–Art Technology Seminar", Tab 26, "Cogeneration Application Considerations", Fisk et al.
"39th GE Turbine State–of–the–Art Technology Seminar", Tab 27, "Performance and Economic Considerations of Repowering Steam Power Plants", Stoll et al.
"39th GE Turbine State–of–the–Art Technology Seminar", Tab 28, "High–Power–Density™ Steam Turbine Design Evolution", J. H. Moore.
"39th GE Turbine State–of–the–Art Technology Seminar", Tab 29, "Advances in Steam Path Technologies", Cofer, IV, et al.
"39th GE Turbine State–of–the–Art Technology Seminar", Tab 30, "Upgradable Opportunities for Steam Turbines", D. R. Dreier, Jr.
"39th GE Turbine State–of–the–Art Technology Seminar", Tab 31, "Uprate Options for Industrial Turbines", R. C. Beck.
"39th GE Turbine State–of–the–Art Technology Seminar", Tab 32, "Thermal Performance Evaluation and Assessment of Steam Turbine Units", P. Albert.
"39th GE Turbine State–of–the–Art Technology Seminar", Tab 33, "Advances in Welding Repair Technology" J. F. Nolan.
"39th GE Turbine State–of–the–Art Technology Seminar", Tab 34, "Operation and Maintenance Strategies to Enhance Plant Profitability", MacGillivray et al.
"39th GE Turbine State–of–the–Art Technology Seminar", Tab 35, "Generator Insitu Inspections", D. Stanton.
"39th GE Turbine State–of–the–Art Technology Seminar", Tab 36, "Generator Upgrade and Rewind", Halpern et al.
"39th GE Turbine State–of–the–Art Technology Seminar", Tab 37, "GE Combined Cycle Product Line and Performance", Chase, et al.
"39th GE Turbine State–of–the–Art Technology Seminar", Tab 38, "GE Combined Cycle Experience", Maslak et al.,.
"39th GE Turbine State–of–the–Art Technology Seminar", Tab 39, "Single–Shaft Combined Cycle Power Generation Systems", Tomlinson et al.
"Advanced Turbine System Program—Conceptual Design and Product Development", Annual Report, Sep. 1, 1994–Aug. 31, 1995.
"Advanced Turbine Systems (ATS Program) Conceptual Design and Product Development", Final Technical Progress Report, vol. 2– Industrial Machine, Mar. 31, 1997, Morgantown, WV.
"Advanced Turbine Systems (ATS Program), Conceptual Design and Product Development", Final Technical Progress Report, Aug. 31, 1996, Morgantown, WV.
"Advanced Turbine Systems (ATS) Program, Phase 2, Conceptual Design and Product Development", Yearly Technical Progress Report, Reporting Period: Aug. 25, 1993–Aug. 31, 1994.
"Advanced Turbine Systems" Annual Program Review, Preprints, Nov. 2–4, 1998, Washington, D.C. U.S. Department of Energy, Office of Industrial Technologies Federal Energy Technology Center.
"ATS Conference" Oct. 28, 1999, Slide Presentation.
"Baglan Bay Launch Site", various articles relating to Baglan Energy Park.
"Baglan Energy Park", Brochure.
"Commercialization", Del Williamson, Present, Global Sales, May 8, 1998.
"Environmental, Health and Safety Assessment: ATS 7H Program (Phase 3R) Test Activities at the GE Power Systems Gas Turbine Manufacturing Facility, Greenville, SC", Document #1753, Feb. 1998, Publication Date: Nov. 17, 1998, Report Nos. DE–FC21–95MC31176—11.
"Exhibit panels used at 1995 product introduction at PowerGen Europe".
"Extensive Testing Program Validates High Efficiency, reliability of GE's Advanced "H" Gas Turbine Technology", Press Information, Press Release, 96–NR14, Jun. 26, 1996, H Technology Tests/pp. 1–4.
"Extensive Testing Program Validates High Efficiency, Reliability of GE's Advanced "H" Gas Turbine Technology", GE Introduces Advanced Gas Turbine Technology Platform: First to Reach 60% Combined–Cycle Power Plant Efficiency, Press Information, Press Release, Power–Gen Europe '95, 95–NRR15, Advanced Technology Introduction/pp. 1–6.

"Gas, Steam Turbine Work as Single Unit in GE's Advanced H Technology Combined–Cycle System", Press Information, Press Release, 95–NR18, May 16, 1995, Advanced Technology Introduction/pp. 1–3.
"GE Breaks 60% Net Efficiency Barrier" paper, 4 pages.
"GE Businesses Share Technology and Experts to Develop State–Of–The–Art Products", Press Information, Press Release 95–NR10, May 16, 1995, GE Technology Transfer/pp. 1–3.
"General Electric ATS Program Technical Review, Phase 2 Activities", T. Chance et al., pp. 1–4.
"General Electric's DOE/ATS H Gas Turbine Development" Advanced Turbine Systems Annual Review Meeting, Nov. 7–8, 1996, Washington, D.C., Publication Release.
"H Technology Commercialization", 1998 MarComm Activity Recommendation, Mar., 1998.
"H Technology", Jon Ebacher, VP, Power Gen Technology, May 8, 1998.
"H Testing Process", Jon Ebacher, VP, Power Gen Technology, May 8, 1998.
"Heavy–Duty & Aeroderivative Products" Gas Turbines, Brochure, 1998.
"MS7001H/MS9001H Gas Turbine, gepower.com website for PowerGen Europe" Jun. 1–3 going public Jun. 15, (1995).
"New Steam Cooling System is a Key to 60% Efficiency For GE "H" Technology Combined–Cycle Systems", Press Information, Press Release, 95–NRR16, May 16, 1995, H Technology/pp. 1–3.
"Overview of GE's H Gas Turbine Combined Cycle", Jul. 1, 1995 to Dec. 31, 1997.
"Power Systems for the 21st Century—"H" Gas Turbine Combined Cycles", Thomas C. Paul et al., Report.
"Power–Gen '96 Europe", Conference Programme, Budapest, Hungary, Jun. 26–28, 1996.
"Power–Gen International", 1998 Show Guide, Dec. 9–11, 1998, Orange County Convention Center, Orlando, Florida.
"Press Coverage following 1995 product announcement"; various newspaper clippings relating to improved generator.
"Proceedings of the Advanced Turbine Systems Annual Program Review Meeting", vol. I, "Industrial Advanced Turbine Systems Program Overview", D.W. Esbeck, p. 3.
"Proceedings of the Advanced Turbine Systems Annual Program Review Meeting", vol. I, "H Gas Turbine Combined Cycle", J. Corman, p. 14.
"Proceedings of the Advanced Turbine Systems Annual Program Review Meeting", vol. I, "Overview of Westinghouse's Advanced Turbine Systems Program", Bannister et al., p. 22.
"Proceedings of the Advanced Turbine Systems Annual Program Review Meeting", vol. I, "Allison Engine ATS Program Technical Review", D. Mukavetz, p. 31.
"Proceedings of the Advanced Turbine Systems Annual Program Review Meeting", vol. I, "Advanced Turbine Systems Program Industrial System Concept Development", S. Gates, p. 43.
"Proceedings of the Advanced Turbine Systems Annual Program Review Meeting", vol. I, "Advanced Turbine System Program Phase 2 Cycle Selection", Latcovich, Jr., p. 64.
"Proceedings of the Advanced Turbine Systems Annual Program Review Meeting", vol. I, "General Electric ATS Program Technical Review Phase 2 Activities", Chance et al., p. 70.
"Proceedings of the Advanced Turbine Systems Annual Program Review Meeting", vol. I, "Technical Review of Westinghouse's Advanced Turbine Systems Program", Diakunchak et al., p. 75.
"Proceedings of the Advanced Turbine Systems Annual Program Review Meeting", vol. I, "Advanced Combustion Turbines and Cycles: An EPRI Perspective", Touchton et al., p. 87.
"Proceedings of the Advanced Turbine Systems Annual Program Review Meeting", vol. I, "Advanced Turbine Systems Annual Program Review", William E. Koop, p. 89.
"Proceedings of the Advanced Turbine Systems Annual Program Review Meeting", vol. I, "The AGTSR Consortium: An Update", Fant et al., p. 93.
"Proceedings of the Advanced Turbine Systems Annual Program Review Meeting", vol. I, "Overview of Allison/AGTSR Interactions", Sy A. Ali, p. 103.
"Proceedings of the Advanced Turbine Systems Annual Program Review Meeting", vol. I, "Design Factors for Stable Lean Premix Combustion", Richards et al., p. 107.
"Proceedings of the Advanced Turbine Systems Annual Program Review Meeting", vol. I, "Ceramic Stationary as Turbine", M. van Roode, p. 114.
"Proceedings of the Advanced Turbine Systems Annual Program Review Meeting", vol. I, "DOE/Allison Ceramic Vane Effort", Wenglarz et al., p. 148.
"Proceedings of the Advanced Turbine Systems Annual Program Review Meeting", vol. I, "Materials/Manufacturing Element of the Advanced Turbine Systems Program", Karnitz et al., p. 152.
"Proceedings of the Advanced Turbine Systems Annual Program Review Meeting", vol. I, "Land–Based Turbine Casting Initiative", Mueller et al., p. 161.
"Proceedings of the Advanced Turbine Systems Annual Program Review Meeting", vol. I, "Pratt & Whitney Thermal Barrier Coatings", Bornstein et al., p. 182.
"Proceedings of the Advanced Turbine Systems Annual Program Review Meeting", vol. I, "Westinhouse Thermal Barrier Coatings", Goedjen et al., p. 194.
"Proceedings of the Advanced Turbine Systems Annual Program Review Meeting", vol. I, "High Performance Steam Development", Duffy et al., p. 200.
"Proceedings of the Advanced Turbine Systems Annual Program Review Meeting", vol. II, "Lean Premixed Combustion Stabilized by Radiation Feedback and heterogeneous Catalysis", Dibble et al., p. 221.
"Proceedings of the Advanced Turbine Systems Annual Program Review Meeting", vol. II, Rayleigh/Raman/LIF Measurements in a Turbulent Lean Premixed Combustor, Nandula et al. p. 233.
"Proceedings of the Advanced Turbine Systems Annual Program Review Meeting", vol. II, "Lean Premixed Flames for Low $No_x$ Combustors", Sojka et al., p. 249.
"Proceedings of the Advanced Turbine Systems Annual Program Review Meeting", vol. II, "Functionally Gradient Materials for Thermal Barrier Coatings in Advanced Gas Turbine Systems", Banovic et al., p. 276.
"Proceedings of the Advanced Turbine Systems Annual Program Review Meeting", vol. II, "Advanced Turbine Cooling, Heat Transfer, and Aerodynamic Studies", Han et al., p. 281.

"Proceedings of the Advanced Turbine Systems Annual Program Review Meeting", vol. II, "Life Prediction of Advanced Materials for Gas Turbine Application", Zamrik et al., p. 310.
"Proceedings of the Advanced Turbine Systems Annual Program Review Meeting", vol. II, "Advanced Combustion Technologies for Gas Turbine Power Plants", Vandsburger et al., p. 328.
"Proceedings of the Advanced Turbine Systems Annual Program Review Meeting", vol. II, "Combustion Modeling in Advanced Gas Turbine Systems", Smoot et al., p. 353.
"Proceedings of the Advanced Turbine Systems Annual Program Review Meeting", vol. II, "Heat Transfer in a Two–Pass Internally Ribbed Turbine Blade Coolant Channel with Cylindrical Vortex Generators", Hibbs et al. p. 371.
"Proceedings of the Advanced Turbine Systems Annual Program Review Meeting", vol. II, "Rotational Effects on Turbine Blade Cooling", Govatzidakia et al., p. 391.
"Proceedings of the Advanced Turbine Systems Annual Program Review Meeting", vol. II, "Manifold Methods in Methane Combustion", Yang et al., p. 393.
"Proceedings of the Advanced Turbine Systems Annual Program Review Meeting", vol. II, "Advanced Multistage Turbine Blade Aerodynamics, Performance, Cooling, and Heat Transfer", Fleeter et al., p. 410.
"Proceedings of the Advanced Turbine Systems Annual Program Review Meeting, vol. II", The Role of Reactant Unmixedness, Strain Rate, and Length Scale on Premixed Combustor Performance, Samuelsen et al., p. 415.
"Proceedings of the Advanced Turbine Systems Annual Program Review Meeting", vol. II, "Experimental and Computational Studies of Film Cooling With Compound Angle Injection", Goldstein et al., p. 423.
"Proceedings of the Advanced Turbine Systems Annual Program Review Meeting", vol. II, "Compatibility of Gas Turbine Materials with Steam Cooling", Desai et al., p. 452.
"Proceedings of the Advanced Turbine Systems Annual Program Review Meeting", vol. II, "Use of a Laser–Induced Fluorescence Thermal Imaging System for Film Cooling Heat Transfer Measurement", M. K. Chyu, p. 465.
"Proceedings of the Advanced Turbine Systems Annual Program Review Meeting", vol. II, Effects of Geometry on Slot–Jet Film Cooling Performance, Hyams et al., p. 474.
"Proceedings of the Advanced Turbine Systems Annual Program Review Meeting", vol. II, "Steam as Turbine Blade Coolant: Experimental Data Generation", Wilmsen et al., p. 497.
"Proceedings of the Advanced Turbine Systems Annual Program Review Meeting", vol. II, "Combustion Chemical Vapor Deposited Coatings for Thermal Barrier Coating Systems", Hampikian et al., p. 506.
"Proceedings of the Advanced Turbine Systems Annual Program Review Meeting", vol. II, "Premixed Burner Experiments: Geometry, Mixing, and Flame Structure Issues", Gupta et al., p. 516.
"Proceedings of the Advanced Turbine Systems Annual Program Review Meeting", vol. II, "Intercooler Flow Path for Gas Turbines: CFD Design and Experiments", Agrawal et al., p. 529.
"Proceedings of the Advanced Turbine Systems Annual Program Review Meeting", vol. II, "Bond Strength and Stress Measurements in Thermal Barrier Coatings", Gell et al., p. 539.
"Proceedings of the Advanced Turbine Systems Annual Program Review Meeting", vol. II, "Active Control of Combustion Instabilities in Low $No_x$ Gas Turbines", Zinn et al., p. 550.
"Proceedings of the Advanced Turbine Systems Annual Program Review Meeting", vol. II, "Combustion Instability Modeling and Analysis", Santoro et al., p. 552.
"Proceedings of the Advanced Turbine Systems Annual Program Review Meeting", vol. II, "Flow and Heat Transfer in Gas Turbine Disk Cavities Subject to Nonuniform External Pressure Field", Roy et al., p. 560.
"Proceedings of the Advanced Turbine Systems Annual Program Review Meeting", vol. II, "Heat Pipe Turbine Vane Cooling", Langston et al., p. 566.
"Proceedings of the Advanced Turbine Systems Annual Program Review Meeting", vol. II, "Improved Modeling Techniques for Turbomachinery Flow Fields", Lakshminarayana et al., p. 573.
"Proceedings of the Advanced Turbine Systems Annual Program Review Meeting", vol. II, "Advanced 3D Inverse Method for Designing Turbomachine Blades", T. Dang, p. 582.
"Proceedings of the Advanced Turbine Systems Annual Program Review Meeting", "ATS and the Industries of the Future", Denise Swink, p. 1.
"Proceedings of the Advanced Turbine Systems Annual Program Review Meeting", "Gas Turbine Association Agenda", William H. Day, p. 3.
"Proceedings of the Advanced Turbine Systems Annual Program Review Meeting", "Power Needs in the Chemical Industry", Keith Davidson, p. 17.
"Proceedings of the Advanced Turbine Systems Annual Program Review Meeting", "Advanced Turbine Systems Program Overview", David Esbeck, p. 27.
"Proceedings of the Advanced Turbine Systems Annual Program Review Meeting", "Westinghouse's Advanced Turbine Systems Program", Gerard McQuiggan, p. 35.
"Proceedings of the Advanced Turbine Systems Annual Program Review Meeting", "Overview of GE's H Gas Turbine Combined Cycle", Cook et al., p. 49.
"Proceedings of the Advanced Turbine Systems Annual Program Review Meeting", "Allison Advanced Simple Cycle Gas Turbine System", William D. Weisbrod, p. 73.
"Proceedings of the Advanced Turbine Systems Annual Program Review Meeting", "The AGTSR Industry–University Consortium", Lawrence P. Golan, p. 95.
"Proceedings of the Advanced Turbine Systems Annual Program Review Meeting", "$NO_x$ and CO Emissions Models for Gas–Fired Lean–Premixed Combustion Turbines", A. Mellor, p. 111.
"Proceedings of the Advanced Turbine Systems Annual Program Review Meeting", "Methodologies for Active Mixing and Combustion Control", Uri Vandsburger, p. 123.
"Proceedings of the Advanced Turbine Systems Annual Program Review Meeting", "Combustion Modeling in Advanced Gas Turbine Systems", Paul O. Hedman, p. 157.
"Proceedings of the Advanced Turbine Systems Annual Program Review Meeting", "Manifold Methods for Methane Combustion", Stephen B. Pope, p. 181.
"Proceedings of the Advanced Turbine Systems Annual Program Review Meeting", "The Role of Reactant Unmixedness, Strain Rate, and Length Scale on Premixed Combustor Performance", Scott Samuelsen, p. 189.

"Proceedings of the Advanced Turbine Systems Annual Program Review Meeting", "Effect of Swirl and Momentum Distribution on Temperature Distribution in Premixed Flames", Ashwani K. Gupta, p. 211.
"Proceedings of the Advanced Turbine Systems Annual Program Review Meeting", "Combustion Instability Studies Application to Land–Based Gas Turbine Combustors", Robert J. Santoro, p. 233.
"Proceedings of the Advanced Turbine Systems Annual Program Review Meeting", "Active Control of Combustion Instabilities in Low $No_x$ Turbines", Ben T. Zinn, p. 253.
"Proceedings of the Advanced Turbine Systems Annual Program Review Meeting", "Life Prediction of Advanced Materials for Gas Turbine Application," Sam Y. Zamrik, p. 265.
"Proceedings of the Advanced Turbine Systems Annual Program Review Meeting", "Combustion Chemical Vapor Deposited Coatings for Thermal Barrier Coating Systems", W. Brent Carter, p. 275.
"Proceedings of the Advanced Turbine Systems Annual Program Review Meeting", "Compatibility of Gas Turbine Materials with Steam Cooling", Vimal Desai, p. 291.
"Proceedings of the Advanced Turbine Systems Annual Program Review Meeting", "Bond Strength and Stress Measurements in Thermal Barrier Coatings", Maurice Gell, p. 315.
"Proceedings of the Advanced Turbine Systems Annual Program Review Meeting", "Advanced Multistage Turbine Blade Aerodynamics, Performance, Cooling and Heat Transfer", Sanford Fleeter, p. 335.
"Proceedings of the Advanced Turbine Systems Annual Program Review Meeting", "Flow Characteristics of an Intercooler System for Power Generating Gas Turbines", Ajay K. Agrawal, p. 357.
"Proceedings of the Advanced Turbine Systems Annual Program Review Meeting", "Improved Modeling Techniques for Turbomachinery Flow Fields", Lakshiminarayana, p. 371.
"Proceedings of the Advanced Turbine Systems Annual Program Review Meeting", "Development of an Advanced 3d & Viscous Aerodynamic Design Method for Turbomachine Components in Utility and Industrial Gas Turbine Applications", Thong Q. Dang, p. 393.
"Proceedings of the Advanced Turbine Systems Annual Program Review Meeting", "Advanced Turbine Cooling, Heat Transfer, and Aerodynamic Studies", Je–Chin Han, p. 407.
"Proceedings of the Advanced Turbine Systems Annual Program Review Meeting", "Heat Transfer in a Two–Pass Internally Ribbed Turbine Blade Coolant Channel with Vortex Generators", S. Acharya, p. 427.
"Proceedings of the Advanced Turbine Systems Annual Program Review Meeting", "Experimental and Computational Studies of Film Cooling with Compound Angle Injection", R. Goldstein, p. 447.
"Proceedings of the Advanced Turbine Systems Annual Program Review Meeting", "Study of Endwall Film Cooling with a Gap Leakage Using a Thermographic Phosphor Fluorescence Imaging System", Mingking K. Chyu, p. 461.
"Proceedings of the Advanced Turbine Systems Annual Program Review Meeting", "Steam as a Turbine Blade Coolant: External Side Heat Transfer", Abraham Engeda, p. 471.
"Proceedings of the Advanced Turbine Systems Annual Program Review Meeting", "Flow and Heat Transfer in Gas Turbine Disk Cavities Subject to Nonuniform External Pressure Field", Ramendra Roy, p. 483.
"Proceedings of the Advanced Turbine Systems Annual Program Review Meeting", "Closed–Loop Mist/Steam Cooling for Advanced Turbine Systems", Ting Wang, p. 499.
"Proceedings of the Advanced Turbine Systems Annual Program Review Meeting", "Heat Pipe Turbine Vane Cooling", Langston et al., p. 513.
"Proceedings of the Advanced Turbine Systems Annual Program Review Meeting", "EPRI's Combustion Turbine Program: Status and Future Directions", Arthur Cohn, p. 535.
"Proceedings of the Advanced Turbine Systems Annual Program Review Meeting", "ATS Materials Support", Michael Karnitz, p. 553.
"Proceedings of the Advanced Turbine Systems Annual Program Review Meeting", "Land Based Turbine Casting Initiative", Boyd A. Mueller, p. 577.
"Proceedings of the Advanced Turbine Systems Annual Program Review Meeting", "Turbine Airfoil Manufacturing Technology", Charles S. Kortovich, p. 593.
"Proceedings of the Advanced Turbine Systems Annual Program Review Meeting", "Hot Corrosion Testing of TBS's", Norman Bornstein, p. 623.
"Proceedings of the Advanced Turbine Systems Annual Program Review Meeting", "Ceramic Stationary Gas Turbine", Mark van Roode, p. 633.
"Proceedings of the Advanced Turbine Systems Annual Program Review Meeting", "Western European Status of Ceramics for Gas Turbines", Tibor Bornemisza, p. 659.
"Proceedings of the Advanced Turbine Systems Annual Program Review Meeting", " Status of Ceramic Gas Turbines in Russia", Mark van Roode, p. 671.
"Status Report: The U.S. Department of Energy's Advanced Turbine systems Program", facsimile dated Nov. 7, 1996.
"Testing Program Results Validate GE's H Gas Turbine—High Efficiency, Low Cost of Electricity and Low Emissions", Roger Schonewald and Patrick Marolda.
"Testing Program Results Validate GE's H Gas Turbine—High Efficiency, Low Cost of Electricity and Low Emissions", Slide Presentation—working draft.
"The Next Step in H . . . For Low Cost Per kW–Hour Power Generation", LP–1 PGE '98.
"Utility Advanced Turbine System (ATS) Technology Readiness Testing and Pre–Commercialization Demonstration", Document #486040, Oct. 1–Dec. 31, 1996, Publication Date, Jun. 1, 1997, Report Nos.: DOE/MC/31176—5628.
"Utility Advanced Turbine System (ATS) Technology Readiness Testing—Phase 3", Document #666274, Oct. 1, 1996–Sep. 30, 1997, Publication Date, Dec. 31, 1997, Report Nos.: DOE/MC/31176—10.
"Utility Advanced Turbine System (ATS) Technology Readiness Testing and Pre–Commercial Demonstration, Phase 3", Document #486029, Oct. 1–Dec. 31, 1995, Publication Date May 1, 1997, Report Nos.: DOE/MC/31176—5340.
"Utility Advanced Turbine System (ATS) Technology Readiness Testing and Pre–Commerical Demonstration—Phase 3", Document #486132, Apr. 1–Jun. 30, 1976, Publication Date, Dec. 31, 1996, Report Nos.: DOE/MC/31176—5660.

"Utility Advanced Turbine System (ATS) Technology Readiness Testing and Pre–Commercial Demonstration—Phase 3", Document #587906, Jul. 1–Sep. 30, 1995, Publication Date, Dec. 31, 1995, Report Nos.: DOE/MC/31176—5339.

"Utility Advanced Turbine System (ATS) Technology Readiness Testing and Pre–Commerical Demonstration" Document #666277, Apr. 1–Jun. 30, 1997, Publication Date, Dec. 31, 1997, Report Nos.: DOE/MC/31176—8.

"Utility Advanced Turbine System (ATS) Technology Readiness Testing and Pre–Commercialization Demonstration" Jan. 1–Mar. 31, 1996, DOE/MC/31176—5338.

"Utility Advanced Turbine System (ATS) Technology Readiness Testing: Phase 3R", Document #756552, Apr. 1–Jun. 30, 1999, Publication Date, Sep. 1, 1999, Report Nos.: DE—FC21–95MC31176–23.

"Utility Advanced Turbine System (ATS) Technology Readiness Testing.", Document #656823, Jan. 1 Mar. 31, 1998, Publication Date, Aug. 1, 1998, Report Nos.: DOE/MC/31176–17.

"Utility Advanced Turbine Systems (ATS) Technology Readiness Testing and Pre–Commercial Demonstration", Annual Technical Progress Report, Reporting Period: Jul. 1, 1995–Sep. 30, 1996.

"Utility Advanced Turbine Systems (ATS) Technology Readiness Testing", Phase 3R, Annual Technical Progress Report, Reporting Period: Oct. 1, 1997–Sep. 30, 1998.

"Utility Advanced Turbine Systems (ATS) Technology Readiness Testing", Document #750405, Oct. 1–Dec. 30, 1998, Publication Date: May 1, 1999, Report Nos.: DE–FC21–95MC31176–20.

"Utility Advanced Turbine Systems (ATS) Technology Readiness Testing", Document #1348, Apr. 1–Jun. 29, 1998, Publication Date Oct. 29, 1998, Report Nos. DE–FC21–95MC31176—18.

"Utility Advanced Turbine Systems (ATS) Technology Readiness Testing—Phase 3", Annual Technical Progress Report, Reporting Period: Oct. 1, 1996–Sep. 30, 1997.

"Utility Advanced Turbine Systems (ATS) Technology Readiness Testing and Pre–Commercial Demonstration", Quarterly Report, Jan. 1–Mar. 31, 1997, Document #666275, Report Nos.: DOE/MC/31176–07.

"Proceedings of the 1997 Advanced Turbine Systems", Annual Program Review Meeting, Oct. 28–29, 1997.

* cited by examiner

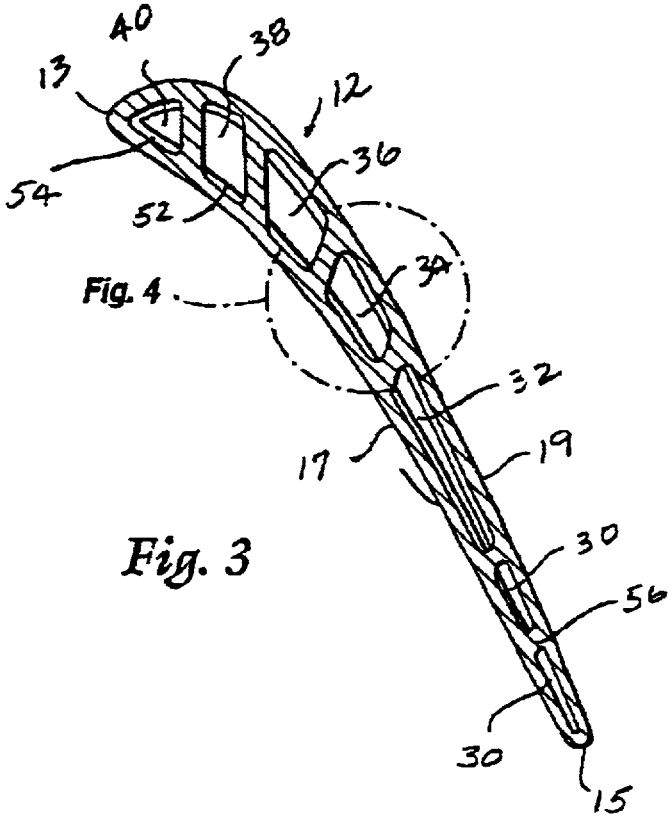
Fig. 3
Fig. 4
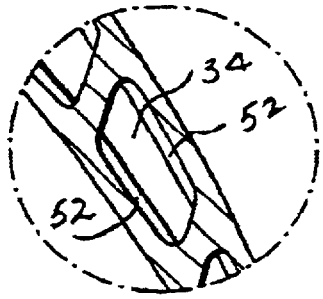
Fig. 5
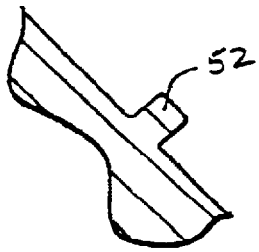
Fig. 6
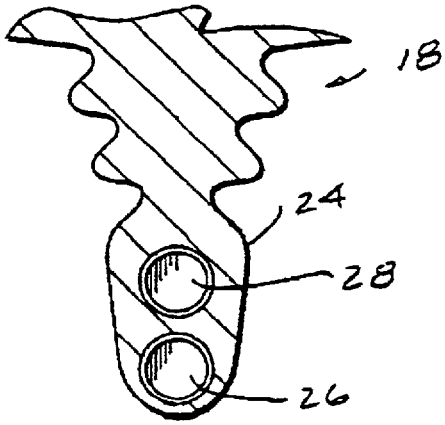

INTERNAL COOLING CIRCUIT FOR GAS TURBINE BUCKET

This is a continuation of Ser. No. 09/236,714 filed Jan. 25, 1999 now abandoned.

This invention was made with Government support under Contract No. DE-FC21-95MC31176 awarded by the Department of Energy. The Government has certain rights in this invention.

BACKGROUND OF THE INVENTION

This invention relates to an internal cooling circuit for a stage two bucket in a gas turbine.

High gas path temperatures are required to achieve high output and high efficiency in gas turbine machines. Several rows (or stages) of rotating blades or buckets, made from various high temperature alloys, are used in the gas turbine to extract energy from the hot gas path. To maintain temperatures of the first and second stage buckets within the material design limits, internal cooling is required. For the high gas path temperatures expected in advanced gas turbine engines, cooling air is not attractive due to the high cycle efficiency penalties associated with using compressor discharge air. Steam is attractive as a viable alternative cooling medium due to its high heat capacity and its availability in a combined cycle unit which includes both steam and gas turbines. This invention addresses the design of an internal cooling circuit for a closed circuit, steam cooled, stage two bucket in a gas turbine engine.

SUMMARY OF THE INVENTION

The internal cooling circuit for a stage two bucket in accordance with this invention incorporates a closed loop serpentine passage in the airfoil portion of the bucket, with multiple 180° turns, and connected to inlet and outlet passages in the radially inner dovetail portion of the bucket. The cooling passages are used to direct the cooling medium (steam in the preferred embodiment), around the bucket, removing heat from the bucket walls. The serpentine path includes alternating radially inward and outward passages, extending from the root of the bucket to the tip, turning and then extending from the tip back to the root. Multiple turns may be employed in the serpentine path, depending on turbine size, temperature requirements, etc.

Turbulators are used to enhance heat transfer from the bucket walls to the cooling medium, and to direct flow into the otherwise hard-to-reach apex of the trailing edge passage. In addition, a turn guide vane is used in the radially outer or tip trailing edge passage to direct flow toward the tip trailing edge corner region. The passage aspect ratios (length to width cross-section dimensions of the various passages) are designed to minimize Buoyancy Numbers in outward flowing passages, thereby maximizing the heat transfer enhancements due to rotation. A discussion of suitable aspect ratios and Buoyancy Numbers can be found in commonly owned U.S. Pat. No. 5,536,143.

In one aspect, the invention thus provides in a gas turbine bucket having a shank portion and an airfoil portion having leading and trailing edges and pressure and suction sides, an internal cooling circuit, the internal cooling circuit having a serpentine configuration including plural radial outflow passages and plural radial inflow passages, and wherein a coolant inlet passage communicates with a first of the radial outflow passages along the trailing edge, the first of the radial outflow passages having a plurality of radially extending and radially spaced elongated rib segments extending between and connecting the pressure and suction sides in a middle region of the first radial outflow passage to prevent ballooning of the pressure and suction sides at the first radial outflow passage.

In another aspect, the invention provides a gas turbine bucket having a shank portion and an airfoil portion having leading and trailing edges and pressure and suction sides, an internal cooling circuit, the internal cooling circuit having a serpentine configuration including plural radial outflow passages and plural radial inflow passages, and wherein a coolant inlet passage communicates with a first of the radial outflow passages along the trailing edge, the internal cooling circuit including turbulator ribs in each of the plurality of radial outflow and radial inflow passages extending at an acute angle to a direction of coolant flow in all but a radial inflow passage along the leading edge.

Advantages of the closed circuit serpentine design, with turbulators and tip turn guide vanes, include improved heat transfer from the buckets to the steam by using a high capacity cooling medium, i.e., the steam, as well as improved overall turbine cycle efficiency over conventional air cooled buckets since steam is extracted from the top cycle of the steam turbine, used to cool the bucket and is then returned to the bottom cycle of the steam turbine in a closed loop. This results in improved overall turbine cycle efficiency over conventional arrangements where compressor discharge air is used for cooling, and then discharged into the hot gas path.

BRIEF DESCRIPTION OF THE DRAWINGS

FIG. 3 is a section taken along the line 3—3 of FIG. 2;

FIG. 4 is an enlarged detail illustrating turbulators on opposite side walls of a cooling passage in the stage 2 bucket in accordance with this invention;

FIG. 5 is a partial section of a turbulator profile in accordance with the invention; and FIG. 6 is a partial side elevation of a lower portion of the bucket shown in FIG. 1, illustrating the coolant inlet and outlets.

DETAILED DESCRIPTION OF THE INVENTION

Figure 1:
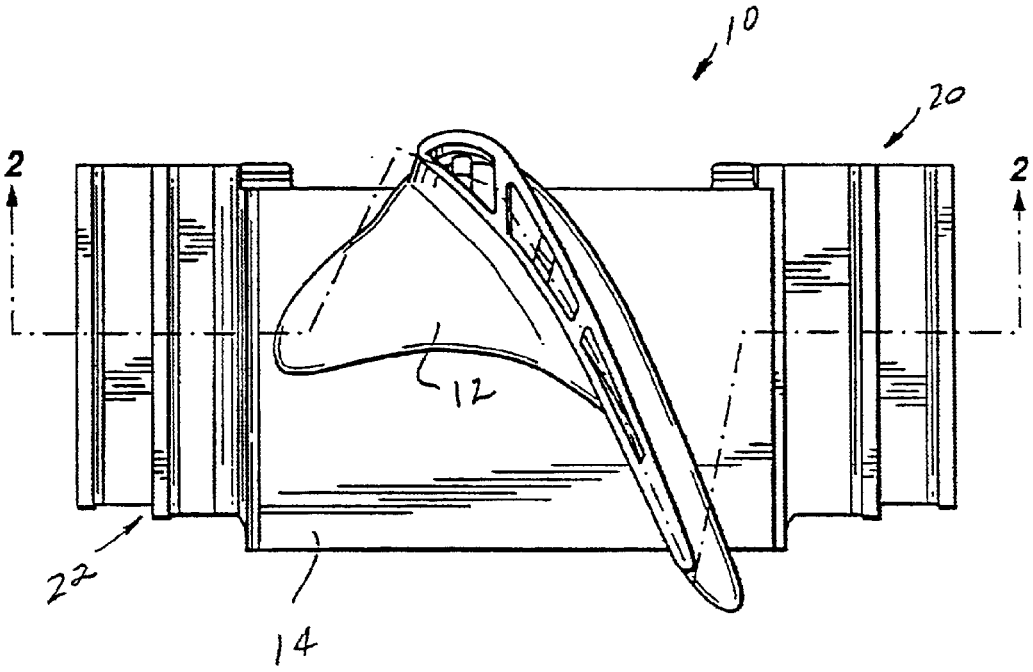
FIG. 1 is a plan view of a second stage bucket in accordance with the invention.
Figure 2:
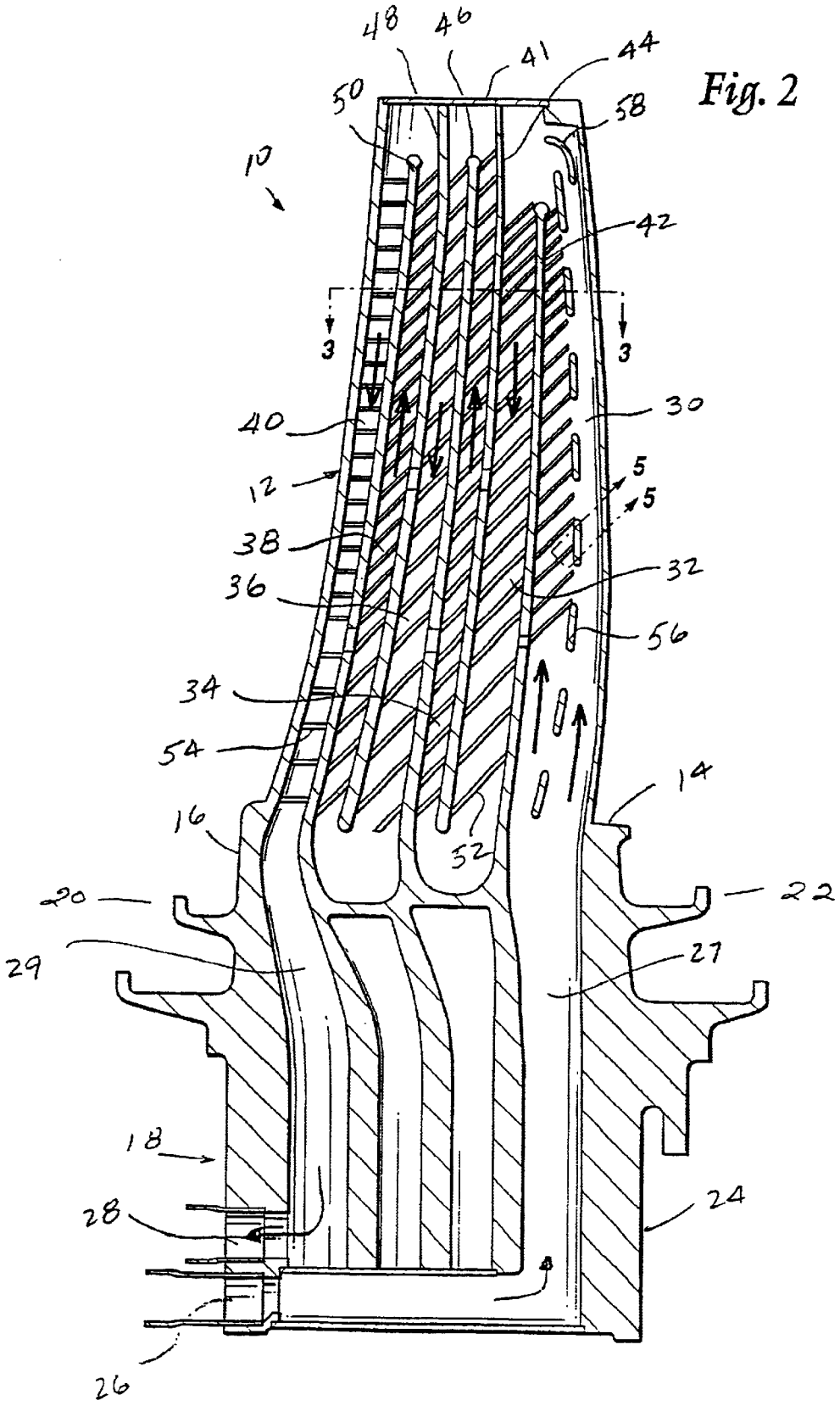
FIG. 2 is a section view taken along the line 2—2 in FIG. 1, but with an airfoil tip cap in place.

Referring to FIGS. 1 and 2, a second stage bucket 10 in accordance with this invention includes an airfoil portion 12 attached to a platform portion 14 which seals the shank 16 of the bucket from the hot gases in the combustion flow path. The shank 16 is attached to a rotor disk by a conventional dovetail 18. Angel wing seals 20, 22 provide sealing of the wheel space cavities. With reference also to FIG. 6, the dovetail 18 includes an extension 24 below the dovetail which serves to supply and remove cooling steam from the bucket via axially arranged passages 26 and 28 which communicate with axially oriented rotor passages (not shown). The airfoil portion 12 has leading and trailing edges 13, 15, respectively, and pressure and suction sides 17, 19, respectively.

With specific reference now to FIG. 2, the internal cooling passages in the second stage bucket define a closed serpentine circuit having a total of six radially extending passages 30, 32, 34, 36, 38 and 40, with alternating radially inward and radially outward passages extending from the primary radial supply passage 27 at root of the bucket to the tip, turning 180° and then extending from the tip and ultimately back to the root to the primary return passage 29. Note that FIG. 2 also shows a tip cap 41 which seals the radially outer end of the airfoil portion 12.

In the illustrated embodiment, there are three radially outer tip turns and two radially inner root turns, forming the six passages, three (30, 34 and 38) in the radially outward direction and three (32, 36 and 40) in the radially inward direction. The various passages are separated by five radially extending ribs or interior partitions 42, 44, 46, 48 and 50 which form the tip and root turns. These ribs extend the full width of the airfoil portion, i.e., from the suction side of the airfoil to the pressure side. As shown, steam flows initially upwardly or radially outwardly through the trailing edge passage 30 first, and radially downwardly or inwardly through the leading edge passage 40 last. The steam is input at the trailing edge cooling passage 30, via passages 26, 27, first, since the trailing edge of the bucket is typically the most difficult region to cool.

Turbulators 52 are used in passages 32–38 to enhance heat transfer from the bucket walls to the cooling medium. These turbulators extend outwardly from opposite walls of the passage as best seen in FIGS. 3, 4 and 5. The turbulators extend only into the cooling passage, not so far as to restrict coolant flow, but far enough to enhance heat transfer from the bucket walls to the cooling medium. In the preferred arrangement, the turbulators 52 are arranged at 45° angles to the direction of flow. Turbulators may be staggered in the radial direction (i.e., so that no turbulators are directly opposite each other) or they may be in lateral alignment (i.e., directly opposite each other) if desired.

In passage 40, turbulators 54 are arranged at a 90° angle to the direction of cooling flow, providing superior heat transfer in the leading edge passage compared to staggered, overlapping turbulators 52 in the remaining passages. Turbulators 54 also "wrap around" the interior leading edge wall as best seen in FIG. 3. Passage 30, extending along the trailing edge of the bucket or blade has a large aspect ratio and requires segmented ribs 56 extending between opposite walls of the bucket in order to prevent ballooning of the walls of the bucket while still allowing free distribution of the steam from the forward part of the passage into the apex trailing edge of the passage.

In addition, a turn guide vane 58 is located at the radially outermost portion of the trailing edge passage 30. This curved guide vane is located to provide a split of the cooling medium around the tip turn between passages 30 and 32 so as to direct needed coolant flow into the trailing edge tip corner region. The crescent shaped guide vane 58 has been found to provide the best flow split with minimum flow losses. Note that the guide vane extends completely between the opposite side walls of the bucket, thereby completely splitting the cooling flow on either side of the vane. This guide vane 58 is a cast-in feature (as are the turbulators 52, 54) included in the ceramic core used to define the internal cooling passages of the bucket in the conventional investment casting process. Turbulator placement, size, height to width ratio, pitch, orientation and corner radii are all selected to provide for the most efficient heat transfer from the bucket walls to the cooling medium.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. In a gas turbine bucket having a shank portion and an airfoil portion having leading and trailing edges and pressure and suction sides, an internal cooling circuit, the internal cooling circuit having a serpentine configuration including plural radial outflow passages and plural radial inflow passages, and wherein a cooling inlet passage communicates with a first of said radial outflow passages along said trailing edge, said first of said radial outflow passages having a plurality of radially extending and radially spaced elongated rib segments extending between and connecting said pressure and suction sides in a middle region of said first radial outflow passage to prevent ballooning of said pressure and suction sides at said first radial outflow passage; said first of said radial outflow passages further including a turning vane in a radially outermost tip portion of said first radial outflow passage upstream of, but not extending into, a first of said radial inflow passages to thereby split coolant flow in the radially outer tip portion and to direct coolant flow in a top corner region of said trailing edge; prior to flow into said first of said radial inflow passages, said turning vane extending between and connected to said pressure and suction sides.

2. The gas turbine bucket of claim 1 wherein said internal cooling circuit includes turbulator ribs in each of said plurality of radial outflow and radial inflow passages.

3. The gas turbine bucket of claim 2 wherein said turbulator ribs extend at an acute angle to a direction of coolant flow in all but one of said radial outflow and radial inflow passages.

4. The gas turbine bucket of claim 3 wherein said one of said radial outflow and radial inflow passages comprises a radial inflow passage along said leading edge.

5. The gas turbine bucket of claim 4 wherein the turbulator ribs in said radial inflow passage along said leading edge extend substantially perpendicular to said direction of coolant flow.

6. The gas turbine bucket of claim 2 wherein said turbulators extend from one of said pressure and suction sides and extend only partly into respective radial inflow and outflow passages.

7. In a gas turbine bucket having a shank portion and an airfoil portion having leading and trailing edges and pressure and suction sides, an internal cooling circuit, the internal cooling circuit having a serpentine configuration including plural radial outflow passages and plural radial inflow passages, and wherein a coolant inlet passage communicates with a first of said radial outflow passages along said trailing edge, said first radial outflow passage further including a turning vane in a radially outermost tip portion of said first radial outflow passage, said internal cooling circuit including turbulator ribs in each of said plurality of radial outflow and radial inflow passages extending at an acute angle to a direction of coolant flow in all but a radial inflow passage along said leading edge, and wherein the turbulator ribs in said radial inflow passage along said leading edge extend substantially perpendicular to said direction of coolant flow.

8. The gas turbine bucket of claim 7 wherein said turning vane extends between and is connected to said pressure and suction sides.

9. The gas turbine bucket of claim 7 wherein said turbulators extend from one of said pressure and suction sides and extend only partly into respective radial inflow and outflow passages.

10. A gas turbine bucket having a shank portion and an airfoil portion having leading and trailing edges and pressure and suction sides; and an internal cooling circuit having a serpentine configuration including plural radial outflow passages and plural radial inflow passages, and wherein a cooling inlet passage communicates with a first of said radial outflow passages along said trailing edge, said first of said radial outflow passages further including a turning vane in a radially outermost tip portion of said first radial outflow passage upstream of, but not extending into, a first of said radial inflow passages to thereby split coolant flow in the radially outer tip portion and to direct coolant flow in a top corner region of said trailing edge, prior to flow into said first of said radial inflow passages, said turning vane extending between and connected to said pressure and suction sides.

11. The gas turbine bucket of claim 10 wherein said internal cooling circuit includes turbulator ribs in each of said plurality of radial outflow and radial inflow passages.

12. The gas turbine bucket of claim 11 wherein said tubulator ribs extend at an acute angle to a direction of coolant flow in all but one of said radial outflow and radial inflow passages.

13. The gas turbine bucket of claim 12 wherein said one of said radial outflow and radial inflow passages comprises a radial inflow passage along said leading edge.

14. The gas turbine bucket of claim 13 wherein the turbulator ribs in said radial inflow passage along said leading edge extend substantially perpendicular to said direction of coolant flow.

15. The gas turbine bucket of claim 11 wherein said tabulators extend from one of said pressure and suction sides and extend only partly into respective radial inflow and outflow passages.

* * * * *